US008579646B2

(12) United States Patent
Lee

(10) Patent No.: US 8,579,646 B2
(45) Date of Patent: Nov. 12, 2013

(54) COMMUNICATION PLUG

(75) Inventor: Ming-Hsi Lee, Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 13/333,222

(22) Filed: Dec. 21, 2011

(65) Prior Publication Data

US 2013/0017701 A1 Jan. 17, 2013

(30) Foreign Application Priority Data

Jul. 13, 2011 (TW) ..... 100124797 A

(51) Int. Cl.
*H01R 13/625* (2006.01)

(52) U.S. Cl.
USPC ..... 439/344; 439/357

(58) Field of Classification Search
USPC ..... 439/344, 345, 350–357
See application file for complete search history.

(56) References Cited

U.S. PATENT DOCUMENTS

| | | | | |
|---|---|---|---|---|
| 4,501,464 | A * | 2/1985 | Bogese, II | 439/344 |
| 4,915,643 | A * | 4/1990 | Samejima et al. | 439/357 |
| 5,439,387 | A * | 8/1995 | Hayashi | 439/345 |
| 5,876,231 | A * | 3/1999 | Pacher | 439/354 |
| 5,993,236 | A * | 11/1999 | Vanderhoof et al. | 439/344 |
| 6,561,832 | B2 * | 5/2003 | Geltsch et al. | 439/345 |
| 7,578,690 | B2 * | 8/2009 | Caveney et al. | 439/344 |
| 7,645,155 | B2 * | 1/2010 | Burke et al. | 439/344 |
| 7,686,638 | B2 * | 3/2010 | Boyd et al. | 439/344 |

* cited by examiner

*Primary Examiner* — Thanh Tam Le
(74) *Attorney, Agent, or Firm* — Muncy, Geissler, Olds & Lowe, PLLC

(57) ABSTRACT

A communication plug for connecting to a communication connector is disclosed, wherein the communication connector has an accommodating slot and the communication plug includes a main body and a fixing portion. The main body can be accommodated in the accommodating slot and the fixing portion is connected to the main body. The fixing portion includes a first part, a second part, and a third part, wherein the third part is connected to the first part and the second part. While the main body is accommodated in the communication connector, the third part is accommodated within the accommodating slot. Consequently, the communication plug is fixed within the communication connector.

6 Claims, 4 Drawing Sheets

COMMUNICATION PLUG

BACKGROUND OF THE INVENTION

1. Field of the Invention

The present invention relates to a communication plug; more particularly, the present invention relates to a communication plug that can be connected to or disconnected from a communication connector without pressing the locking part of the communication plug.

2. Description of the Related Art

Communication plugs are the most commonly used components in the transmission of signals. On a network cable, for example, one end of the cable has to be connected to an electrical apparatus, such as a computer, via a communication plug, and the other end of the network cable has to be connected to a network appliance such as a hub, a router, or a broadband router via a communication plug to sustain the transmission of network signals between the electrical apparatus and the network appliance. A communication plug of the prior art is shown in FIG. 1 and FIG. 2.

As shown in FIG. 1 and FIG. 2, a locking part 110 is mounted on a communication plug 100 in order to ensure that the communication plug 100 is firmly situated within the communication connector 90. Generally speaking, as shown in FIG. 2, users have to press the locking part 110 in order to allow the communication plug 100 to enter the communication connector 90. After entering the communication connector 90, the communication plug 100 is fixed within the communication connector 90 because the locking part 110 is locked with the opening of the communication connector 90. For disconnecting the communication plug 100 from the communication connector 90, users have to press the locking part 110 to release the connection between the locking part 110 and the opening of the communication connector 90. However, the locking part 110 can be broken if force is applied improperly. If the locking part 110 is broken, the connecting force between the communication plug 100 and the communication connector 90 will fail, and consequently the network connection will fail, which is inconvenient for users.

Therefore, there is a need for a new communication plug that can be connected to or disconnected from a communication connector without application of pressure to the locking part to obviate the aforementioned problems.

SUMMARY OF THE INVENTION

It is an object of the present invention to provide a communication plug that can be plugged in or unplugged without pressing any part of the communication plug.

It is another object of the present invention to provide a communication plug whose fixing portion is completely situated inside the communication connector while the communication plug is connected to the communication connector.

To achieve the abovementioned objects, the communication plug of the present invention is used for connecting to a communication connector, wherein the communication connector has an accommodating slot. The communication plug includes a main body and a fixing portion. The main body can be accommodated in the accommodating slot and the fixing portion is connected to the main body. The fixing portion includes a first part, a second part, and a third part, wherein the third part is connected to the first part and the second part. When the main body is accommodated in the communication connector, the third part is accommodated within the accommodating slot so as to fix the communication plug to the communication connector.

DETAILED DESCRIPTION OF THE PREFERRED EMBODIMENT

The advantages and innovative features of the invention will become more apparent from the following detailed descriptions when taken together with the accompanying drawings.

Figure 3:
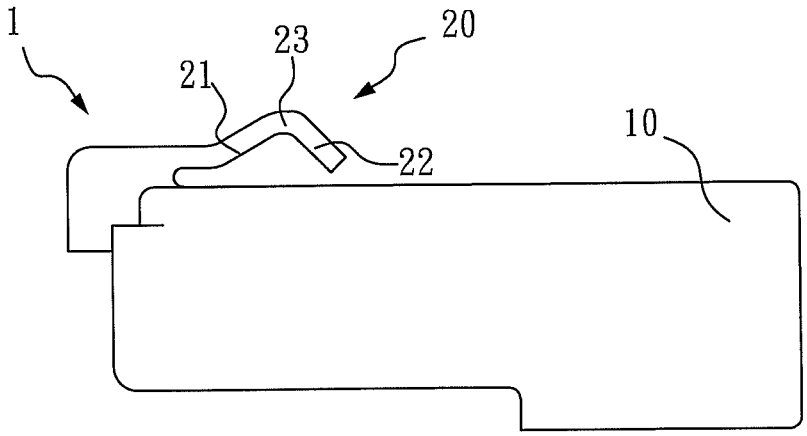
FIG. 3 is a cross-sectional schematic drawing of the communication plug of the present invention.
Figure 3A:
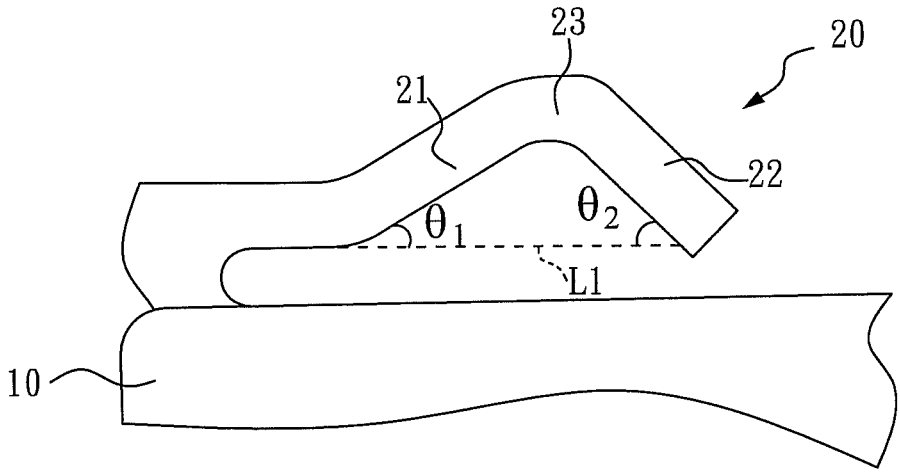
FIG. 3A is an enlarged schematic drawing of the fixing portion of the communication plug of the present invention.

Please refer to FIG. 3 and FIG. 3A regarding one embodiment of the communication plug of the present invention, wherein FIG. 3 is a cross-sectional schematic drawing of the communication plug of the present invention; FIG. 3A is an enlarged schematic drawing of the fixing portion of the communication plug of the present invention.

As shown in FIG. 3 and FIG. 3A, the communication plug 1 of the present invention comprises a main body 10 and a fixing portion 20, wherein the fixing portion 20 is connected to the main body 10. In one embodiment of the present invention, the fixing portion 20 and the main body 10 are integrally-formed; however, the present invention is not limited to this. The fixing portion 20 comprises a first part 21, a second part 22, and a third part 23, wherein the third part 23 is connected to the first part 21 and the second part 22. In one embodiment of the present invention, the first part 21, the second part 22, and the third part 23 are integrally formed, but the present invention is not limited to that. According to one embodiment of the present invention, the shape of the fixing portion 20 is substantially an inverted U-shape, and its top end is the third part 23 of the fixing portion 20. The first part 21 and the second part 22 are inclined walls, each of which is individually situated at a side of the third part 23. A first leaning angle $\theta_1$ is formed by the first part 21 and a horizontal plane L1, and a second leaning angle $\theta_2$ is formed by the second part 22 and a horizontal plane L1. As shown in FIG. 3A, the degree of the first leaning angle $\theta_1$ is substantially smaller than the second leaning angle $\theta_2$.

Figure 4:
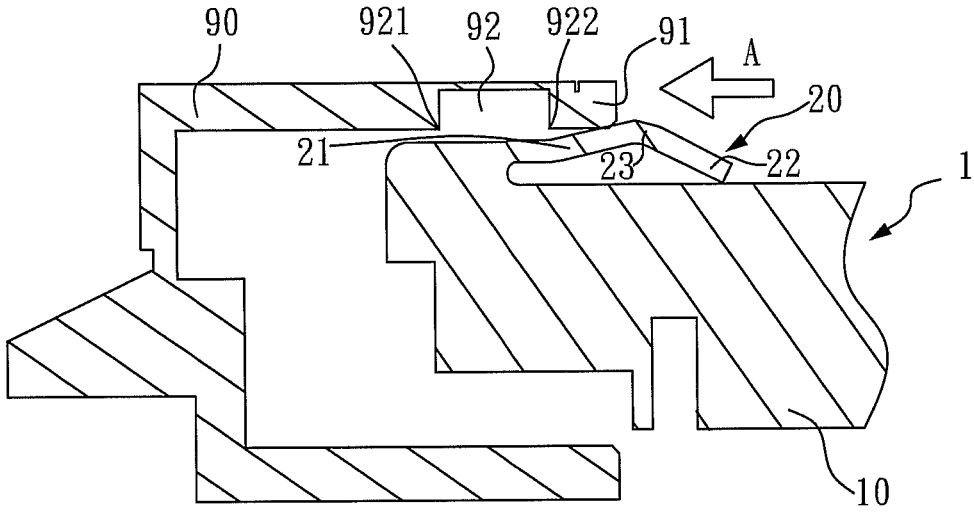
FIG. 4 illustrates a schematic view when the communication plug enters the communication connector.
Figure 5:
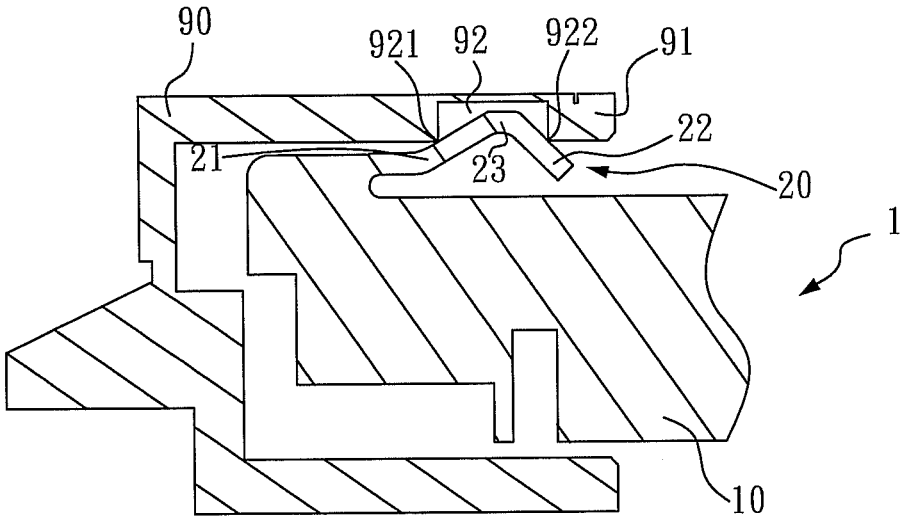
FIG. 5 illustrates a schematic view when the communication plug is fixed within the communication connector.
Figure 6:
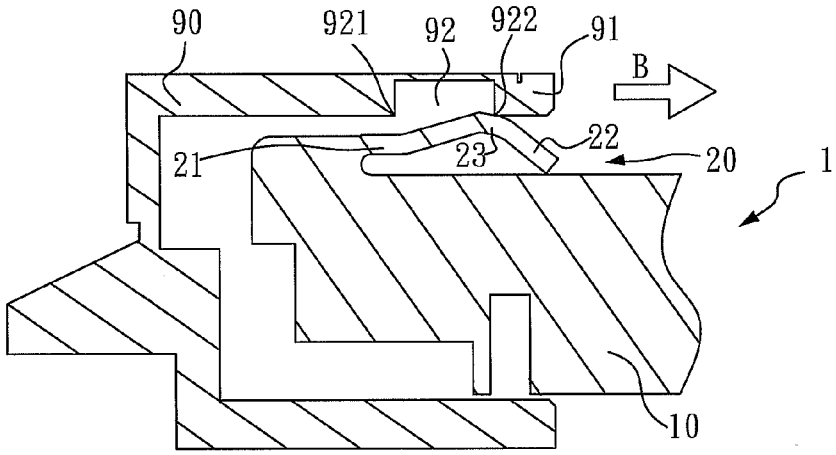
FIG. 6 illustrates a schematic view when the communication plug is disconnected from the communication connector.

Please refer to FIG. 4 to FIG. 6, wherein FIG. 4 illustrates a schematic view when the communication plug enters the communication connector; FIG. 5 illustrates a schematic view when the communication plug is fixed to the communication connector; FIG. 6 illustrates a schematic view when the communication plug is disconnected from the communication connector.

As shown in FIG. 4, the communication plug 1 of the present invention is used for connecting to a communication connector 90, wherein the communication connector 90 comprises an opening end 91 and an accommodating slot 92. The accommodating slot 92 has a first end point 921 and a second end point 922. When the communication plug 1 enters the communication connector 90, the communication plug 1 of the present invention moves along the direction indicated by arrow A. The opening end 91 of the communication connector 90 presses the first part 21 of the fixing portion 20 such that the second part 22 and the third part 23 are depressed and move toward the main body 10. As a result, the shape of the fixing portion 20 is changed; i.e., the height of the fixing portion 20 is reduced such that the communication plug 1 of the present invention can enter the communication connector 90 smoothly.

Figure 1:
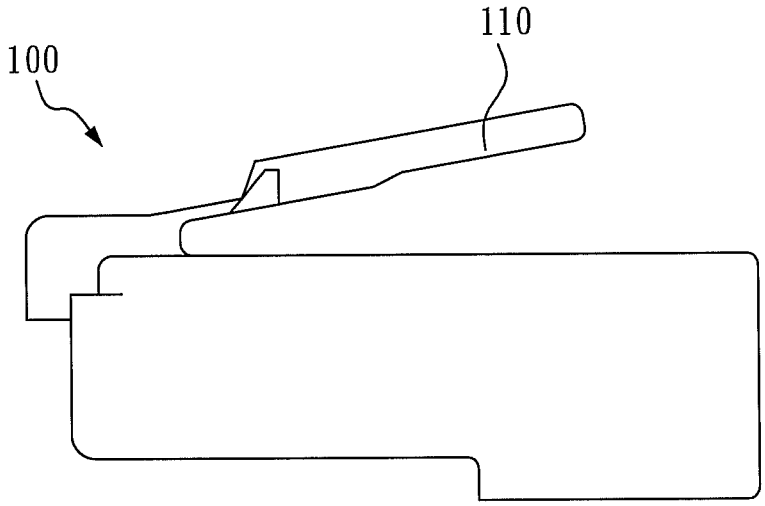
FIG. 1 (PRIOR ART)
FIG. 1 illustrates a schematic view of the prior art of the communication plug.
Figure 2:
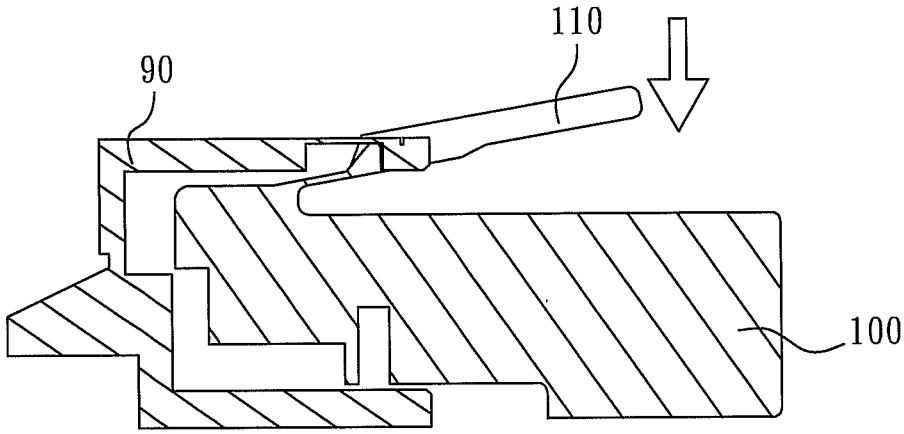
FIG. 2 (PRIOR ART)
FIG. 2 illustrates a schematic view of a prior art of the communication plug and the communication connector.

As shown in FIG. 5, when the communication plug 1 of the present invention is locked in the communication connector 90, the first part 21 of the fixing portion 20 presses against the first end point 921 of the accommodating slot 92, and the second part 22 of the fixing portion 20 presses against the second end point 922 of the accommodating slot 92. As a result, the third part 23 of the fixing portion 20 is confined within the accommodating slot 92. By using the pressure between the first end point 921 and the second end point 922, the fixing portion 20 can be confined in the accommodating slot 92 such that the communication plug 1 of the present invention can be fixed within the communication connector 90. At the same time, the fixing portion 20 is situated inside the communication connector 90 completely, which is different from the communication plug 100 and the communication connector 90 of the prior art, in which the locking part 110 of the communication plug 100 is still exposed outside the communication connector 90 after connection (as shown in FIG. 2). Furthermore, the communication plug 1 of the present invention can be connected with the communication connector 90 without application of pressure to the fixing portion 20 by the user, which prevents potential damage to the fixing portion 20 from occurring during application of pressure and also extends the durability of the communication plug 1 of the present invention.

According to one embodiment of the present invention, the communication plug 1 of the present invention is a network plug that can be connected to a network cable, and the communication connector 90 a network connector, but the present invention is not limited to this embodiment. The communication plug 1 of the present invention can also connect to a telephone cable and a telephone connector to increase the adaptability of the present invention.

As shown in FIG. 6, for disconnecting the communication plug 1 of the present invention from the communication connector 90, the communication plug 1 of the present invention moves along the direction indicated by arrow B. At this point, the second end point 922 of the accommodating slot 92 presses the second part 22 and the third part 23 of the fixing portion 20 such that the second part 22 and the third part 23 are depressed and move toward the main body 10 again to change the shape of the fixing portion 20. The change reduces the height of the fixing portion 20 such that the communication plug 1 of the present invention can be disconnected from the communication connector 90 smoothly.

It is noted that, in order to facilitate the connection between the communication plug 1 of the present invention and the communication connector 90, the first leaning angle $\theta_1$ shown in FIG. 3A is substantially smaller than 20 degrees. In order to facilitate the disconnection between the communication plug 1 of the present invention and the communication connector 90, the second leaning angle $\theta_2$ is substantially 45 degrees. Moreover, according to one embodiment of the present invention, the fixing portion 20 is made of an elastic plastic material, but the present invention is not limited to that; any material that can be deformed is suitable.

To sum up, when using the communication plug 1 of the present invention, users only have to push the cable that connects the communication plug 1 of the present invention, such as a network cable or a telephone cable, and then the communication plug 1 of the present invention can enter the communication connector 90 smoothly due to the shape-changing feature of the fixing portion 20, which is caused by the structure of the communication connector 90. Furthermore, the communication plug 1 of the present invention can be firmly fixed within the communication connector 90 to ensure the stability of signal transmission by the contact force between the first end point 921 and the second end point 922 of the accommodating slot 92 and the fixing portion 20. The communication plug 1 of the present invention can be disconnected from the communication connector 90 by the user pulling on the cable that connects the communication plug 1 of the present invention, such as a network cable or a telephone cable, and then the communication plug 1 of the present invention can be disconnected from the communication connector 90 smoothly due to the shape-changing feature of the fixing portion 20, which is the result of the structure of the communication connector 90. When using the communication plug 1 of the present invention, users do not have to perform the pressing action shown in the prior art; i.e., users do not have to apply pressure to the locking part 110 of the communication plug 100 for connecting or disconnecting the communication plug 100.

It must be noted that the above-mentioned embodiments are only for illustration purposes. It is intended that the present invention cover modifications and variations of this invention provided that they fall within the scope of the following claims and their equivalents. Therefore, it will be apparent to those skilled in the art that various modifications and variations can be made to the structure of the present invention without departing from the scope or spirit of the invention.

What is claimed is:

1. A communication plug for connecting to a communication connector, wherein the communication connector comprises an accommodating slot, the communication plug comprising:

a main body that can be accommodated in the communication connector; and a fixing portion, connected to the main body, comprising a first part, a second part, and a third part, wherein the third part is connected to the first part and the second part; the first part, the second part, and the third part are integrally-formed; a first leaning angle is formed by the first part and a horizontal plane and a second leaning angle is formed by the second part and the horizontal plane, wherein the first leaning angle is smaller than the second leaning angle; wherein while the communication plug is entering the communication connector, the first part is pressed by an opening end of the communication connector for allowing the communication plug to enter the communication connector; while the main body is accommodated in the communication connector, the first part leans against a first end point of the accommodating slot, the second part leans against a second end point of the accommodating slot, and the third part is accommodated in the accommodating slot for fixing the communication plug within the communication connector.

2. The communication plug as claimed in claim 1, wherein while the communication plug is being disconnected from the communication connector, the second part and the third part are pressed by the second end point for allowing the communication plug to disconnect from the communication connector.

3. A communication plug for connecting to a communication connector, wherein the communication connector comprises an accommodating slot, the communication plug comprising:

a main body that can be accommodated in the communication connector; and a fixing port, which is substantially an inverted U-shape and connected to the main body, comprising a first part, a second part, and a third part, wherein the third part is connected to the first part and the second part the first part, the second part, and the third part are integrally-formed; a first leaning angle is formed by the first part and a horizontal plane and a second leaning angle is formed by the second part and the horizontal plane, wherein the first leaning angle is smaller than the second leaning angle; wherein while the communication plug is entering the communication connector, the first part is pressed by an opening end of the communication connector for allowing the communication plug to enter the communication connector; while the main body is accommodated in the communication connector, the first part contacts a first end point of the accommodating slot, the second part contacts a second end point of the accommodating slot, and the third part is accommodated in the accommodating slot for fixing the communication plug within the communication connector.

4. The communication plug, as claimed in claim 3, wherein while the communication plug is being disconnected from the communication connector, the second part and the third part are pressed by the second end point for allowing the communication plug to disconnect from the communication connector.

5. The communication plug as claimed in claim 1, wherein the fixing portion is made of flexible plastics.

6. The communication plug as claimed in claim 1, wherein the main body and the fixing portion are integrally formed.

* * * * *